US011060531B2

(12) United States Patent
Badafem et al.

(10) Patent No.: US 11,060,531 B2
(45) Date of Patent: Jul. 13, 2021

(54) HEATING PUMP

(71) Applicant: Johnson Electric S.A., Murten (CH)

(72) Inventors: Awade Badafem, Shenzhen (CN); Shao Peng Mo, Shenzhen (CN); Min Li, Shenzhen (CN); Jin Jin Wu, Shen Zhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 389 days.

(21) Appl. No.: 15/273,004

(22) Filed: Sep. 22, 2016

(65) Prior Publication Data

US 2017/0082120 A1 Mar. 23, 2017

(30) Foreign Application Priority Data

Sep. 22, 2015 (CN) ..... 201510610913.X

(51) Int. Cl.

| | |
|---|---|
| ***F04D 29/58*** | (2006.01) |
| ***F04D 13/06*** | (2006.01) |
| ***F04D 29/22*** | (2006.01) |
| ***F04D 29/42*** | (2006.01) |

(52) U.S. Cl.

CPC ..... *F04D 29/586* (2013.01); *F04D 13/06* (2013.01); *F04D 29/22* (2013.01); *F04D 29/4293* (2013.01); *F04D 29/5806* (2013.01)

(58) Field of Classification Search

CPC ..... F04B 25/02; F04B 25/06; F04B 25/0606; F04B 29/406; F04B 29/426; F04B 29/58; F04D 7/02; F04D 7/06; F04D 13/02; F04D 13/025; F04D 13/06; F04D 13/0606; F04D 13/0653; F04D 13/0693; F04D 29/22;

(Continued)

(56) References Cited

U.S. PATENT DOCUMENTS 2,762,311 A * 9/1956 Litzenberg ..... F04D 29/66 417/357
3,348,487 A * 10/1967 Miller ..... H02K 44/04 310/11

(Continued)

FOREIGN PATENT DOCUMENTS

CN 204192548 U 3/2015
DE 102013211180 A1 12/2014

(Continued)

*Primary Examiner* — Bryan M Lettman
(74) *Attorney, Agent, or Firm* — Muncy, Geissler, Olds and Lowe, P.C.

(57) ABSTRACT

A heating pump includes a pump body and a driving motor. The pump body includes a pump housing with a water inlet and a water outlet, a heating member fixed in an interior of the pump housing, and an impeller connected with the driving motor. The heating member includes fittings and a heating coiled pipe connected between the fittings and bent into an arc. The impeller is disposed at an upper part of the pump housing, one end of the driving motor is disposed adjacent the impeller, and the heating coiled pipe circles around a radial side portion of part of the driving motor. The heating pump has a rational design and high heat exchange efficiency. The safety auxiliary motor has a low requirement for power. The axial size of the water pump is significantly reduced.

9 Claims, 4 Drawing Sheets

(58) Field of Classification Search
CPC ..... F04D 29/4293; F04D 29/586; F04D 29/5806; F04D 29/5893; H02K 5/20; H02K 9/00
See application file for complete search history.

(56) References Cited

U.S. PATENT DOCUMENTS

| | | | | | |
|---|---|---|---|---|---|
| 5,172,754 | A * | 12/1992 | Graber | F24V 40/10 | 165/47 |
| 5,408,960 | A * | 4/1995 | Woytowich | B60L 1/02 | 123/142.5 E |
| 6,464,471 | B1 * | 10/2002 | Mathis | F04D 13/06 | 417/350 |
| 2012/0263581 | A1 * | 10/2012 | Li | D06F 39/085 | 415/177 |
| 2016/0040686 | A1 * | 2/2016 | Li | F04D 1/00 | 415/177 |
| 2016/0169230 | A1 * | 6/2016 | Block | F04D 29/426 | 415/203 |

FOREIGN PATENT DOCUMENTS

| | | | | |
|---|---|---|---|---|
| EP | 1762169 | A2 | 3/2007 | |
| WO | WO-2014198427 | A1 * | 12/2014 | F04D 13/0606 |
| WO | WO-2015161685 | * | 1/2015 | F04D 1/00 |

* cited by examiner

HEATING PUMP

CROSS REFERENCE TO RELATED APPLICATIONS

This non-provisional patent application claims priority under 35 U.S.C. § 119(a) from Patent Application No. 201510610913.X filed in The People's Republic of China on Sep. 22, 2015, the entire contents of which are hereby incorporated by reference.

FIELD OF THE INVENTION

The present invention relates to a heating pump, and in particular to a heating pump that increases a contact area between a heating member and a fluid by using a heating coiled pipe.

BACKGROUND OF THE INVENTION

Following the development of mechanical industry, various power systems have made a rapid progress. Along with the higher and higher demand of energy, heating pumps have become more and more widely used.

The heating pump includes a pump housing having a chamber, a heating member fixed to the pump housing and received in the chamber, an impeller received in the chamber, and a motor fixed to the pump housing to drive the impeller. The conventional heating pump includes the motor and an impeller driven by the motor. The impeller drives the fluid into the pump housing via an inlet and drives the fluid out of the pump housing via an outlet. The fluid in the pump contacts a heating pipe to exchange heat. The heating pipe is usually fixed to a top plate of the pump, such that the top plate is heated and dissipates the heat to the environment, which leads to a waste of energy. In addition, the heating pipe continues the heating even if there is no flow in the pump, which may result in a dangerous situation such as fire due to overheating. Furthermore, the heating pipe is usually disposed in an interior of the motor, which leads to a great length of the heating pump. This is disadvantageous in the design of the device that uses the heating pump.

SUMMARY OF THE INVENTION

Accordingly, there is a desire for a heating pump which can address the above problems.

A heating pump is provided which includes a pump body and a driving motor. The pump body includes a pump housing with a water inlet and a water outlet, a heating member fixed in an interior of the pump housing, and an impeller connected with the driving motor. The heating member includes fittings and a heating coiled pipe connected between the fittings and bent into an arc. The impeller is disposed at an upper part of the pump housing, one end of the driving motor is disposed adjacent the impeller, and the heating coiled pipe circles around a radial side portion of part of the driving motor.

Preferably, the pump housing comprising an upper housing portion and lower housing portion, the upper housing portion comprises a top plate, the lower housing portion comprises a bottom plate, the upper housing portion and the lower housing portion are isolated from each other by a central isolating part, the central isolating part comprising a cylindrical sleeve extending toward the impeller, for receiving a part of the driving motor, and the heating coiled pipe circles around an circumference of the cylindrical sleeve.

Preferably, the top plate is made of plastic, the heating coiled pipe passes through the top plate to form the fittings and are fixed to the top plate through flanges, and other portions of the heating coiled pipe does not contact the top plate.

Preferably, the heating coiled pipe is provided with a thermostat regulator, one end of the thermostat regulator extends out of the top plate to connect with a power line of the heating coiled pipe.

Preferably, a thermo-fuse is disposed in an interior of the heating coiled pipe.

Preferably, the bottom plate is provided with a cooling fan connected with the driving motor.

Preferably, the heating coiled pipe comprises one spiral turn extending along a circumferential direction of the driving motor.

Preferably, the heating coiled pipe comprises three spiral turns extending along a circumferential direction of the driving motor.

Preferably, the driving motor is a direct current motor.

The above preferred conditions can be freely combined to achieve various preferred embodiments of the present invention as long as such combination is compatible with common sense in the art.

In embodiments of the heating pump of the present invention, the heating pump has a rational design and higher heat exchange efficiency. The auxiliary motor has a lower requirement for power. The axial size of the water pump is significantly reduced. The top plate of the pump housing uses the plastic material and is thermally insulated from the heating member, thereby preventing the top plate from scalding the user.

DETAILED DESCRIPTION OF THE PREFERRED EMBODIMENTS

Figure 1:
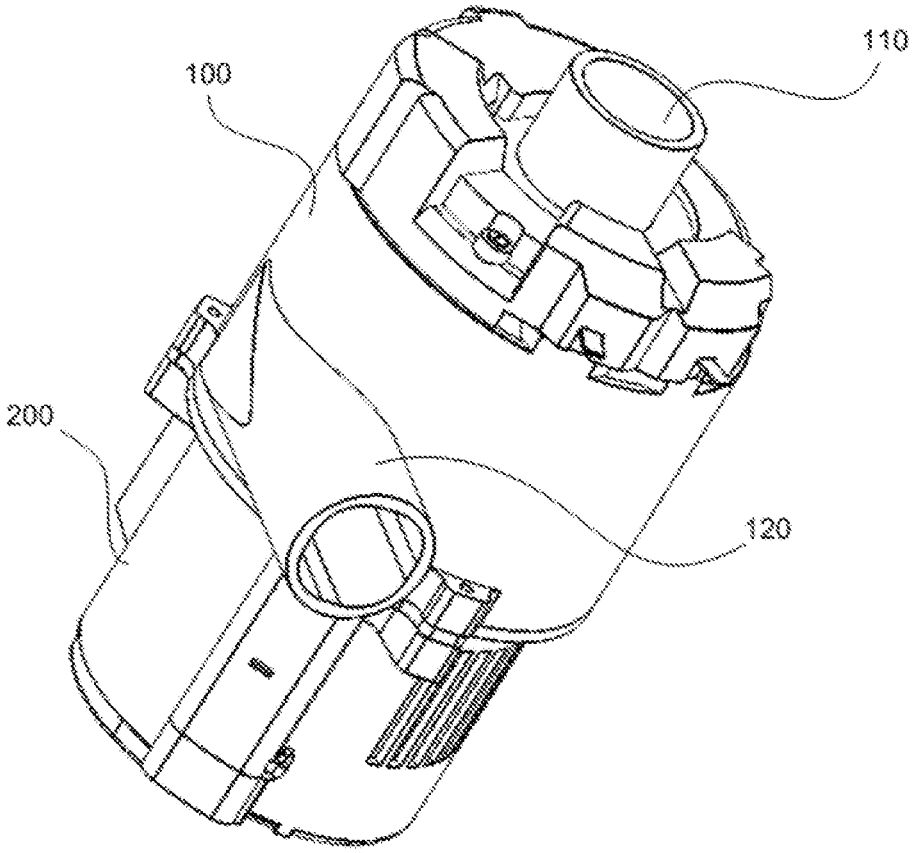
FIG. 1 is a perspective view of a heating pump in accordance with one embodiment of the present invention.

It should be noted that the figures are not drawn to scale and that elements of similar structures or functions are generally represented by like reference numerals for illustrative purposes throughout the figures. It should also be noted that the figures are only intended to facilitate the description of the preferred embodiments. The figures do not illustrate every aspect of the described embodiments and do not limit the scope of the present disclosure.

FIG. 1 is a perspective view of a heating pump in accordance with one embodiment of the present invention. The heating pump 10 includes an upper housing portion 100 and a lower housing portion 200. A water pump impeller is disposed in an interior of the upper housing portion 100. A driving motor is disposed in an interior of the lower housing portion 200, for driving the water pump impeller. The upper housing portion includes a water inlet 110 and a water outlet 120. Water enters the pump body via the water inlet 110 and is then discharged out of the water outlet 120 under the driving of the impeller.

Figure 2:
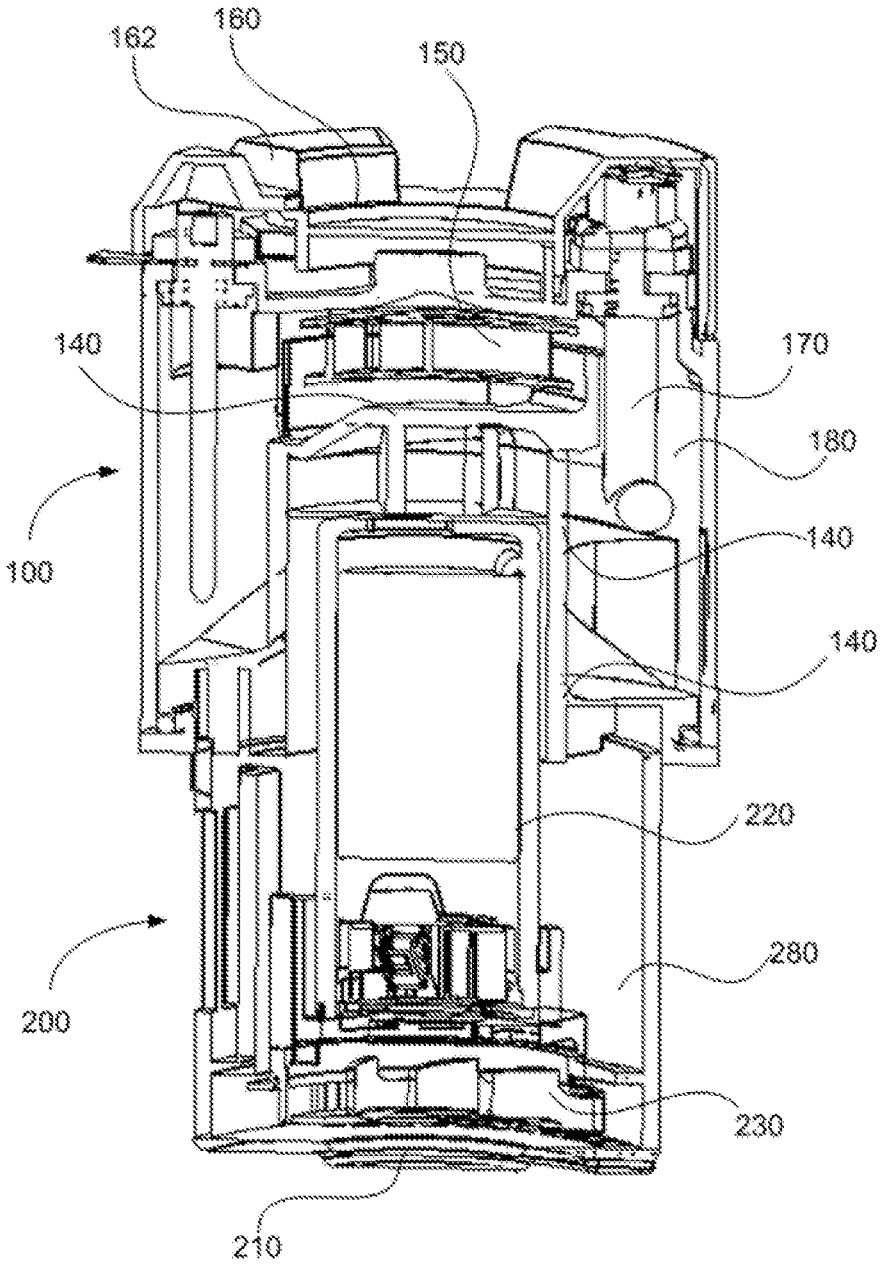
FIG. 2 is a sectional view of the heating pump.

FIG. 2 is a sectional view of the heating pump 10. A top plate 160 is disposed at a top of the upper housing portion 100. An impeller 150 for pumping the water and a heating coiled pipe 170 are disposed below the top plate 160. The upper housing portion 100 and the lower housing portion 200 are isolated apart from each other by a central isolating part 140. The central isolating part 140 includes a cylindrical sleeve extending toward the impeller, for receiving a portion of the driving motor 220. The central isolating part 140 isolates the upper housing portion 110 from the lower housing portion 120, such that the water flows only within the upper housing portion.

Each of the upper housing portion 100 and the lower housing portion 200 includes a generally cylindrical sidewall. The sidewall, top plate 160 and the central isolating part 140 cooperatively define an upper cavity 180. The heating coiled pipe 170 is fixed to the top plate 160 and extends downwardly to circle around a side portion of the cylindrical sleeve of the central isolating part 140. The cavity 180 is in flow communication with an outside space of the upper housing portion 110 via the water outlet 120 and water inlet 110. During the course of being thrown to the water outlet 120 by the impeller, the water contacts the heating part so as to be heated. As such, the heating pump 10 increases the kinetic energy of the water and heats the water as well.

A bottom plate is formed at a bottom end of the lower housing portion 200. The sidewall, bottom plate 210 and central isolating part 140 cooperatively define a lower cavity 280. The driving motor 220 is disposed within the lower cavity 280 and extends into the central isolating part 140. A cooling fan 230 is disposed at a bottom end of the motor 220. The cooling fan 230 is connected to an output shaft of the motor 220, for cooing the motor when the motor rotates.

The impeller 150 is assembled to the top plate 160 through a sealing assembly and is received in the upper cavity 180, and therefore is rotatable about a central axis of a bearing relative to the top plate 160. The rotary shaft of the motor 220 is fixedly connected to the impeller 150 so that the motor 220 can drive the impeller 150 to rotate. An outer cover 162 is mounted to a side of the top plate 160 opposite from the impeller, which covers the top plate 160 and fittings of the heating member 170 and exposes only a necessary electrical connecting port for power supply to the heating member 170.

Figure 3:
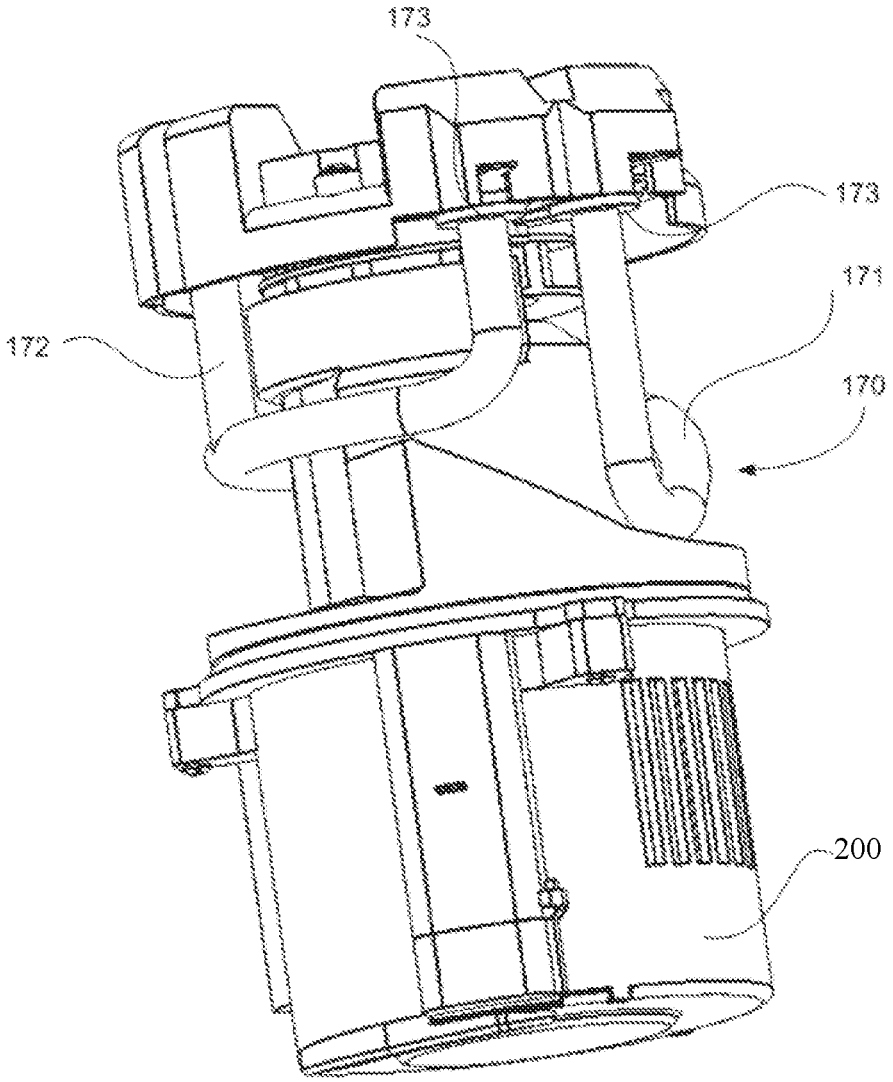
FIG. 3 is a partial view of the heating pipe of the heating pump, with a portion of the pump housing being removed.
Figure 4:
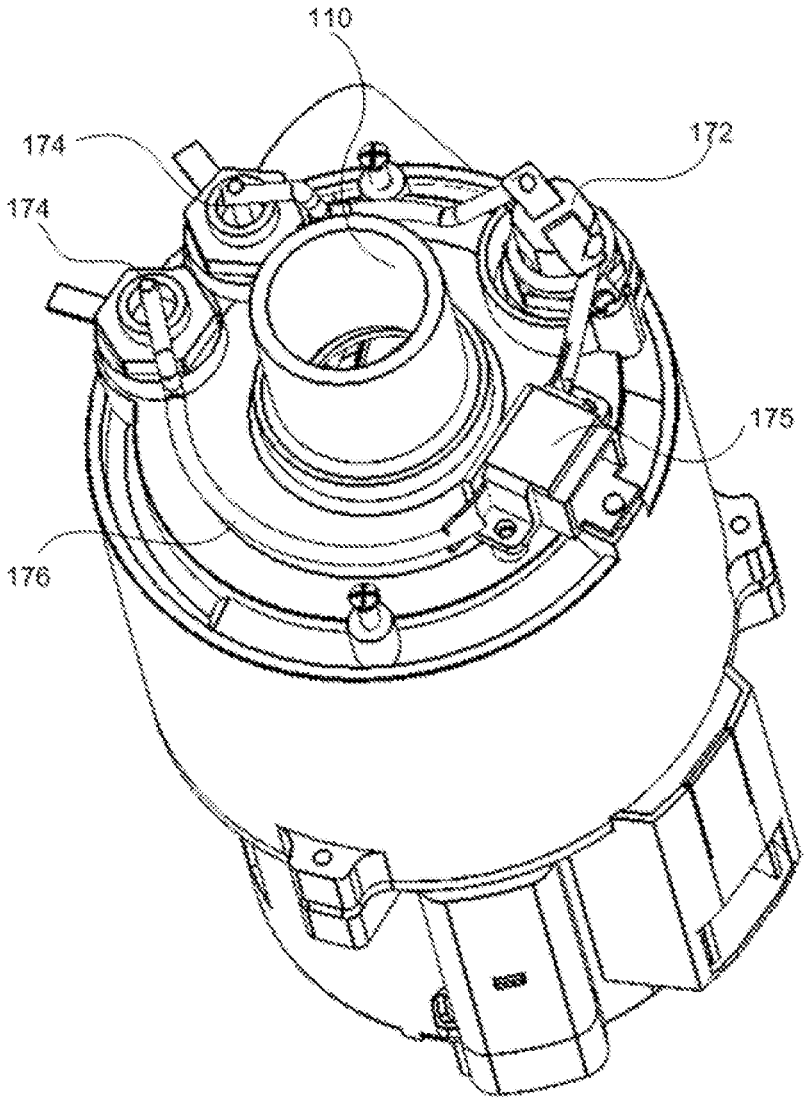
FIG. 4 illustrates the power lines at the top of the heating pump, with a top portion of the pump housing being removed.

FIG. 3 and FIG. 4 are partial views of the heating pipe 170 of the heating pump 10, with a portion of the pump housing being removed. The heating member 170 includes fittings 173 and a heating coiled pipe 171 connected between the fittings. In comparison with the fittings 173, the heating coiled pipe 171 is made of a material having a higher electrical resistivity. The heating coiled pipe 171 bends into an arc close to a circle. The fittings bend from two distal ends of the arc and extend in parallel in a direction perpendicular to a plane in which the heating coiled pipe 171 is located. The heating coiled pipe 171 is surrounding disposed at the side portion of the cylindrical sleeve of the central isolating part 140. Because the driving motor 220 is partially disposed in the cylindrical sleeve, the heating coiled pipe surrounds a circumference of the portion of the driving motor. As such, the heating coiled pipe and the motor are axially partially overlapped, thereby reducing the whole length of the heating pump.

The two fittings 173 of the heating pipe 170 both extend through the top plate 160 to an outside of the top plate. Each of the two fittings 173 is connected to the electrical connecting port 175 through a conducting line 176 for connecting the power. The fittings 173 are fixed to the top plate 160 through a flange. The heating coiled pipe 171 does not contact the top plate and is completely suspended within the upper cavity.

In one embodiment, the heating coiled pipe 171 is provided with a thermostat regulator 172. One end of the thermostat regulator 172 is disposed on the heating coiled pipe 171 to detect a temperature of the heating coiled pipe 171, and the other end extends out of the top plate 160 to connect with the conducting line. When the temperature of the heating coiled pipe 171 is over high, the thermostat regulator 172 disconnects the conducting line, causing the heating coiled pipe to stop heating. After the temperature decreases, the thermostat regulator 172 connects the conducting line to resume the heating. As such, when no water passes through the heating pump 10, danger due to overheat of the heating coiled pipe 171 can be avoided.

In one embodiment, the heating coiled pipe 171 includes a thermo-fuse disposed therein. When the heating coiled pipe 171 is overheating, the thermo-fuse blows to discontinue the electrical current, which likewise can protect the device. In case the thermo-fuse blows, the blown thermo-fuse needs to be replaced with a new one to continue to use the heating pump.

In this embodiment, the upper housing portion 100 and the lower housing portion 200 are fixedly connected together with screws. It should be understood that the upper housing portion and the lower housing portion may be connected in another suitable manner such as by snap-fit means.

In operation, a fluid, such as water, enters the impeller 150 via the water inlet 110 and is then thrown to the water outlet 120 after being accelerated by the impeller 150. During the course of flowing to the water outlet 120, the fluid contacts the heating coiled pipe 171 so as to be heated. In one embodiment, the heating coiled pipe 171 has only one turn which has a small resistance to the fluid. In another embodiment, the heating coiled pipe 171 may have three turns, thus increasing the fluid heating result.

The motor 220 is a high-voltage direct current motor. Alternatively, the motor 220 may also be another suitable type of motor.

The heating pump of the present invention has been sufficiently described as above. In this heating pump, the heating coiled pump and the driving motor partially overlap in the axial direction, which reduces the axial size of the heating pump. By thermally insulating the heating coiled pipe from the housing, the heat exchange efficiency is enhanced.

Although the invention is described with reference to one or more preferred embodiments, it should be appreciated by those skilled in the art that various modifications are possible. Therefore, the scope of the invention is to be determined by reference to the claims that follow.

The invention claimed is:

1. A heating pump comprising:

a pump body comprising a pump housing with a water inlet and a water outlet, a heating member fixed in an interior of the pump housing, and an impeller connected with a driving motor, the heating member comprising fittings and a heating coiled pipe connected between the fittings and bent into an arc, the impeller being disposed at an upper part of the pump housing; and the driving motor having one end disposed adjacent the impeller, the driving motor being disposed such that the heating coiled pipe circles around a radial side portion of part of the driving motor, wherein the pump housing comprises an upper housing portion and a lower housing portion, the upper housing portion comprises a top plate, the lower housing portion comprises a bottom plate, the upper housing portion and the lower housing portion are isolated from each other by a central isolating part, the impeller and the heating member are received in the upper housing portion, the central isolating part comprises a sleeve extending into the upper housing portion toward the impeller, a lower part of the driving motor is received in the lower housing portion, and an upper part of the driving motor is received in the sleeve, and the heating coiled pipe circles around the impeller and a circumference of the sleeve where the upper part of the driving motor is received, wherein the heating coiled pipe comprises one spiral turn extending along a circumferential direction of the driving motor, a number of the fittings is two, and a bottom of a section of the spiral turn below one of the fittings is lower than a bottom of another section of the spiral turn below the other one of the fittings.

2. The heating pump of claim 1, wherein the top plate is made of plastic, the heating coiled pipe passes through the top plate to form the fittings and are fixed to the top plate through flanges, and other portions of the heating coiled pipe do not contact the top plate.

3. The heating pump of claim 2, wherein the heating coiled pipe is provided with a thermostat regulator, one end of the thermostat regulator extends out of the top plate to connect with a power line of the heating coiled pipe.

4. The heating pump of claim 2, wherein a thermo-fuse is disposed in an interior of the heating coiled pipe.

5. The heating pump of claim 2, wherein the bottom plate is provided with a cooling fan connected with the driving motor.

6. The heating pump of claim 1, wherein the driving motor is a direct current motor.

7. The heating pump of claim 1, wherein the impeller is disposed radially inside the fittings and the heating coiled pipe.

8. A heating pump comprising:

a pump body comprising a pump housing with a water inlet and a water outlet, a heating member fixed in an interior of the pump housing, and an impeller connected with a driving motor, the heating member comprising two fittings and a heating coiled pipe connected between the fittings and bent into an arc, the impeller being disposed at an upper part of the pump housing, wherein the heating coiled pipe comprises one spiral turn extending along a circumferential direction of the driving motor and a bottom of a section of the spiral turn below one of the fittings is lower than a bottom of another section of the spiral turn below the other one of the fittings; and the driving motor having one end disposed adjacent the impeller, the driving motor being disposed such that the heating coiled pipe circles around a radial side portion of the impeller and a part of the driving motor.

9. A heating pump comprising:

a pump body comprising a pump housing with a water inlet and a water outlet, a heating member fixed in an interior of the pump housing, and an impeller connected with a driving motor, the heating member comprising fittings and a heating coiled pipe connected between the fittings and bent into an arc, the impeller being disposed at an upper part of the pump housing; and the driving motor having one end disposed adjacent the impeller, the driving motor being disposed such that the heating coiled pipe circles around a radial side portion of part of the driving motor, wherein the pump housing comprises a top plate, the fittings of the heating member extend through the top plate to an outside of the top plate, the fittings are connected with a conducting line, a thermostat regulator is mounted to an outside of the heating coiled pipe, one end of the thermostat regulator is disposed on the heating coiled pipe to detect a temperature of the heating coiled pipe, and the other end of the thermostat regulator extends out of the top plate to connect with the conducting line.

* * * * *